US009993097B2

(12) United States Patent
Phipps et al.

(10) Patent No.: US 9,993,097 B2
(45) Date of Patent: Jun. 12, 2018

(54) DRINKING CUP HAVING AN ADJUSTABLE HANDLE

(71) Applicant: Helen of Troy Limited, Belleville, St. Michael (BB)

(72) Inventors: Troy Hunter Phipps, Brooklyn, NY (US); Tiffany Chang Chen, New York, NY (US); Edward J. Laganis, Hoboken, NJ (US)

(73) Assignee: Helen of Troy Limited, Belleville, St. Michael (BB)

( * ) Notice: Subject to any disclaimer, the term of this patent is extended or adjusted under 35 U.S.C. 154(b) by 0 days. days.

(21) Appl. No.: 14/844,491

(22) Filed: Sep. 3, 2015

(65) Prior Publication Data

US 2017/0065111 A1 Mar. 9, 2017

(51) Int. Cl.

| | |
|---|---|
| ***B65D 47/06*** | (2006.01) |
| ***A47G 19/22*** | (2006.01) |
| ***B65D 25/28*** | (2006.01) |
| ***B65D 41/04*** | (2006.01) |

(52) U.S. Cl.

CPC ..... *A47G 19/2272* (2013.01); *B65D 25/28* (2013.01); *B65D 41/04* (2013.01); *B65D 47/06* (2013.01); *B65D 2525/285* (2013.01)

(58) Field of Classification Search

CPC ..... B65D 23/104; B65D 23/106

See application file for complete search history.

(56) References Cited

U.S. PATENT DOCUMENTS 1,681,197 A 8/1928 Rueff
3,990,596 A * 11/1976 Hoftman ..... A61J 9/06 215/11.1
4,368,826 A * 1/1983 Thompson ..... B29C 49/54 215/398
4,497,417 A 2/1985 Tabet
6,352,235 B2 3/2002 Cizek
6,959,827 B2 11/2005 Morano et al.
6,978,908 B2 12/2005 Morano et al.
7,648,038 B2 * 1/2010 Brozell ..... B65D 23/106 215/396
8,181,800 B2 5/2012 Rees et al.
8,333,299 B2 12/2012 Kemper et al.

(Continued)

FOREIGN PATENT DOCUMENTS

FR 2715062 7/1995
GB 2268922 1/1994

OTHER PUBLICATIONS

International Search Report filed in PCT/US2016/048019 dated Feb. 3, 2017.

*Primary Examiner* — Jeffrey Allen

(74) *Attorney, Agent, or Firm* — Rankin, Hill & Clark LLP

(57) ABSTRACT

A drinking cup includes a container with an open top and defining a longitudinal axis. The container includes a neck having a plurality of first detents provided on an outer surface. A handle assembly includes a rim and at least one handle integrally formed with the rim. The rim defines an opening sized to receive the container neck. The handle assembly has a plurality of second detents shaped to mate with the first detents, wherein selective engagement of the first and second detents configured to allow incremental rotational movement of the handle assembly on the neck about the container axis.

9 Claims, 6 Drawing Sheets

(56) References Cited

U.S. PATENT DOCUMENTS

| | | | | |
|---|---|---|---|---|
| 2005/0056611 | A1* | 3/2005 | Hakim | A61J 9/00<br>215/11.6 |
| 2007/0272651 | A1* | 11/2007 | DiPasquale | B65D 23/104<br>215/396 |
| 2008/0223808 | A1 | 9/2008 | Mendenhall et al. | |

* cited by examiner

DRINKING CUP HAVING AN ADJUSTABLE HANDLE

BACKGROUND

Portable drinking cups typically include a container that holds a beverage and a lid covering the container. The lid may be detachable from the container and is provided with a drinking spout. The drinking spout often includes holes, slots, or other flow-limiting features, such as a valve assembly. The flow-limiting features reduce the amount of spilling that occurs if the drinking cup becomes inverted or is otherwise overturned, but allow liquid flow for drinking when suction is applied to the drinking spout. One popular type of drinking cup includes at least one, and more often two handles, secured to opposite sides of the container and positioned 180° apart which facilitate easy grasping of the drinking cups. When the user holds the handled container, the orientation of the handles relative to the drinking spout is not always in the most comfortable or optimal position. Although some prior art drinking cups have adjustable handles, such drinking cups do not allow the handles to remain fixed once they have been adjusted to a desired setting. For example, the handles of such prior art drinking cups will undesirably change position when the drinking cup is dropped onto the floor. Other prior art drinking cups with locking handles only allow the handles to be readjusted if the entire drinking cup is disassembled. Therefore, there is a need for a drinking cup with adjustable handles that remain fixed after the handles have been properly oriented and that can be easily readjusted, if needed, without resorting to disassembling the entire drinking cup.

BRIEF DESCRIPTION

In accordance with one aspect, a drinking cup comprises a container with an open top and defining a longitudinal axis. The container includes a neck having a plurality of first detents provided on an outer surface. A handle assembly includes a rim and at least one handle integrally formed with the rim. The rim defines an opening sized to receive the container neck. The handle assembly has a plurality of second detents shaped to mate with the first detents, wherein selective engagement of the first and second detents is configured to allow incremental rotational movement of the handle assembly on the neck about the container axis.

In accordance with another aspect, a drinking cup comprises a container with an open top and defining a longitudinal axis. The container includes a neck having an outer surface provided with external threads and an outwardly extending annular collar spaced from the external threads. A handle assembly includes a rim and pair of handles integrally formed with the rim. The rim defines an opening sized to receive the container neck and is supported on the collar. The neck and the rim have a cooperating detent arrangement configured to allow rotational movement of the handle assembly in predetermined increments about the container axis. A lid includes a skirt having internal threads that mate with the external threads of the neck enabling the lid to be screwed onto the container thereby preventing removal of the handle assembly In accordance with yet another aspect, a method of assembling a drinking cup comprises providing a container including a neck having external threads; providing one of a plurality of ridges and a plurality of protuberances on the container neck; providing a handle assembly including a rim and pair of handles integrally formed with the rim; providing the other of the plurality of ridges and a plurality of protuberances on the rim of the handle assembly; and positioning the rim of the handle assembly over the container neck including positioning the plurality of protuberances in grooves defined by the plurality of ridges.

DETAILED DESCRIPTION

It should, of course, be understood that the description and drawings herein are merely illustrative and that various modifications and changes can be made in the structures disclosed without departing from the present disclosure. In general, the figures of the exemplary drinking cup are not to scale. It should be appreciated that the term "plurality" means "two or more", unless expressly specified otherwise. It will also be appreciated that the various identified components of the exemplary drinking cup disclosed herein are merely terms of art that may vary from one manufacturer to another and should not be deemed to limit the present disclosure.

Figure 1:
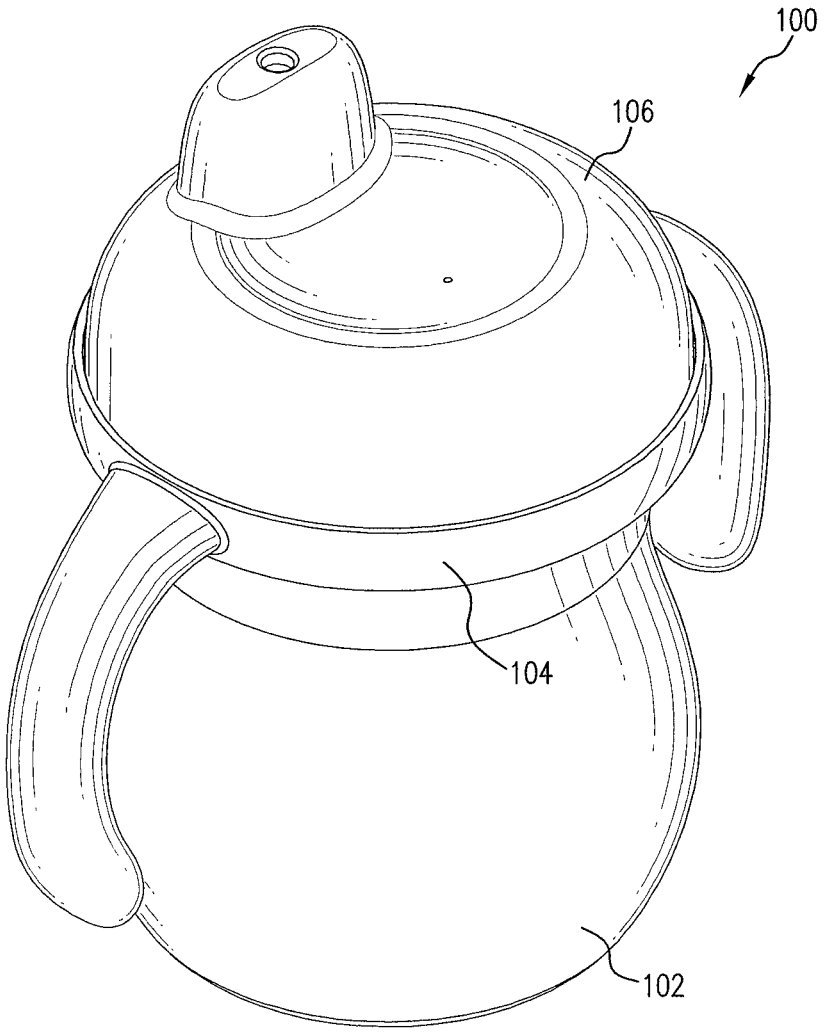
FIG. 1 is a perspective view of an exemplary drinking cup according to the present disclosure.
Figure 2:
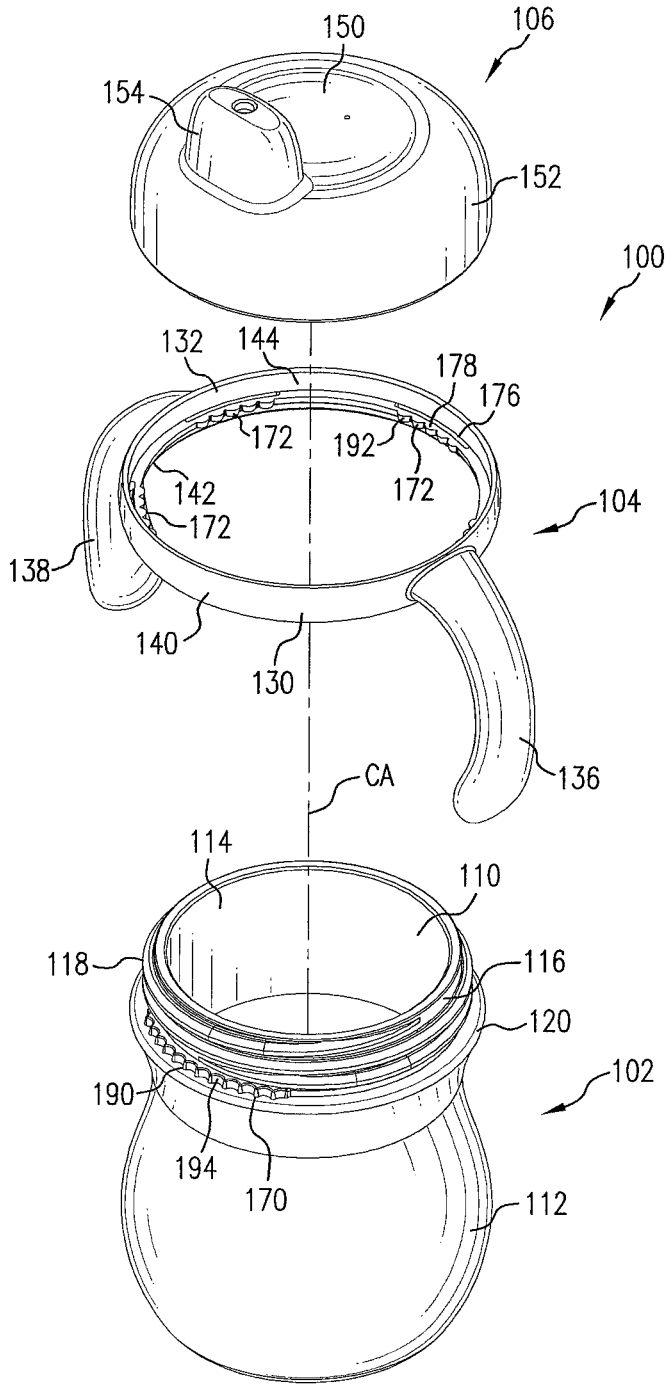
FIG. 2 is an exploded perspective view of the drinking cup of FIG. 1.
Figure 3:
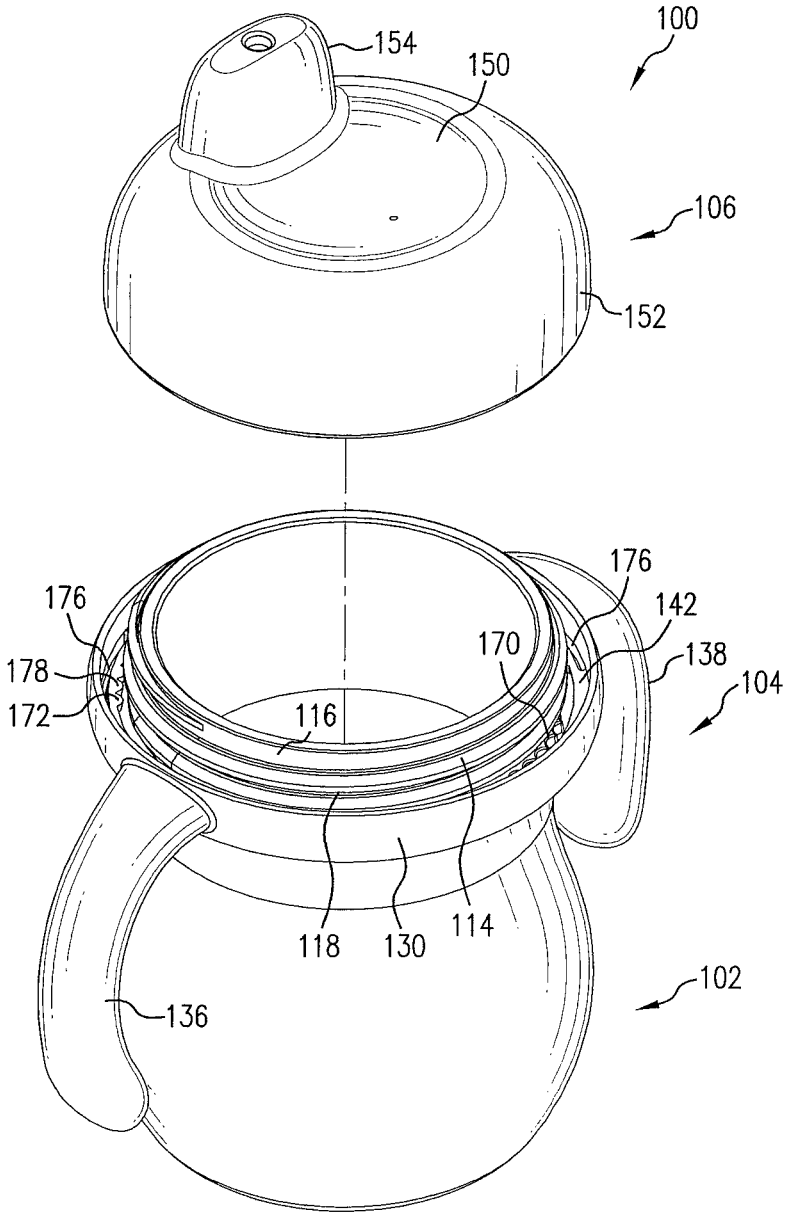
FIG. 3 is a partial exploded perspective view of the drinking cup of FIG. 1.

Referring now to the drawings, wherein like numerals refer to like parts throughout the several views, FIGS. 1-3 illustrate an exemplary drinking cup 100 including a drink container 102, a handle assembly 104 mounted to the container, and a cap or lid 106 configured to fit onto the container 102 for closing an open top 110 of the drink container. Each of the container 102, the handle assembly 104 and the lid 106 can be made from a rigid plastic material. In the depicted embodiment, the drinking cup 100 is a toddler or sippy cup, but it should be appreciated that the illustration is by way of example only and that alternative drinking cups are contemplated. The container 102 includes a cup portion 112 for retaining a liquid (not shown), a neck 114 having an outer surface 116 provided with external threads 118 and defines a longitudinal axis CA. The drink container 102 further includes an outwardly extending annular collar or shoulder 120 spaced from the external threads 118 and located generally at an interface between the cup portion 112 and the neck 114.

The handle assembly 104 includes a rim 130 with a central opening 132 sized to receive the container neck 114. The rim 130 and central opening 132 are configured to allow the handle assembly 104 to slide axially on and off the drink container 102, allowing the user to decide on whether or not to use the handle assembly with the drinking cup 100. At least one handle is integrally formed with the rim 130 to define a one-piece unit. In the depicted embodiment, a pair of handles 136, 138 are integrally formed with the rim 130. The handles 136, 138 are positioned along an outer portion 140 of the rim 130 and are positioned opposite to each other.

Figure 4:
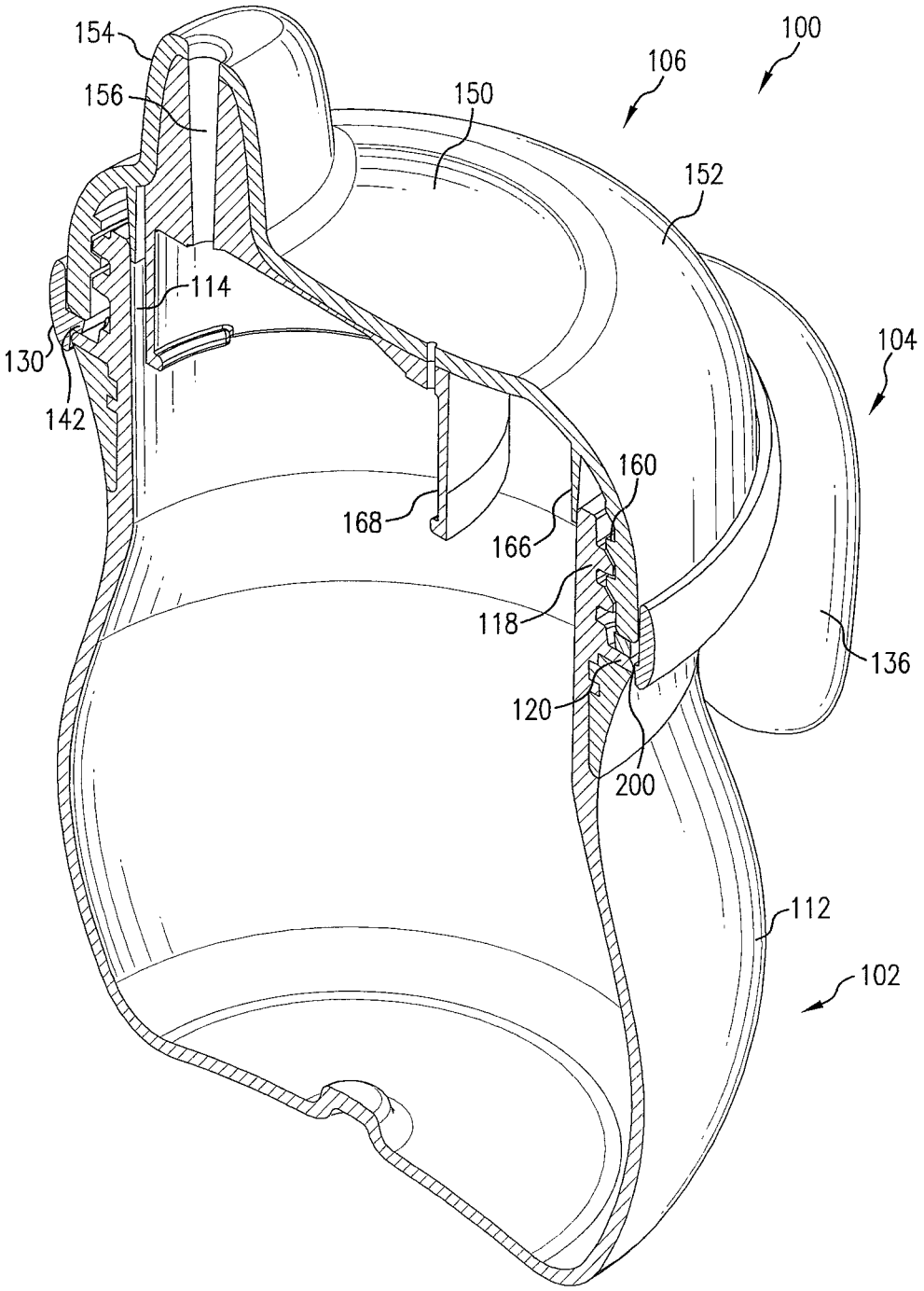
FIG. 4 is a cross-sectional perspective view of the drinking cup of FIG. 1.
Figure 5:
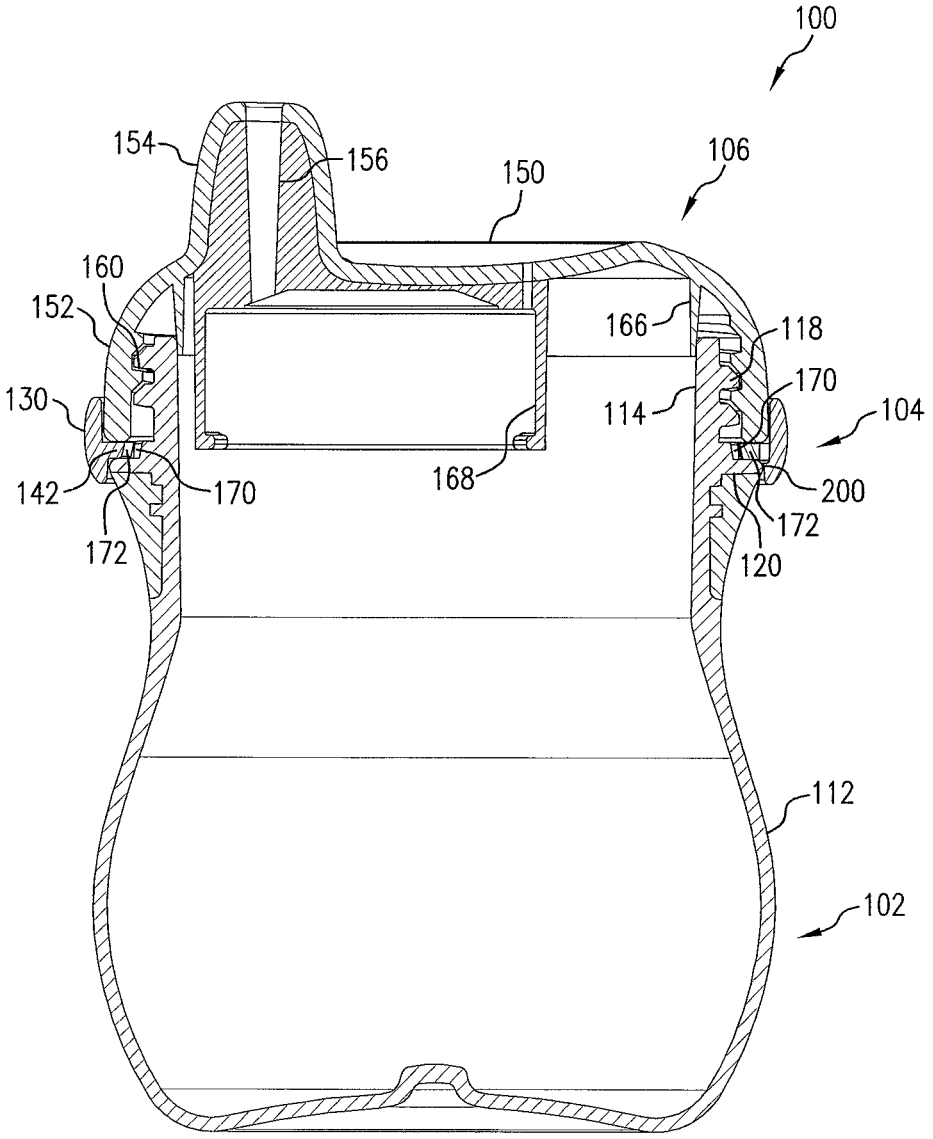
FIG. 5 is another cross-sectional view of the drinking cup of FIG. 1.

According to one aspect, the handles 136, 138 are secured to opposite sides of the rim 130 and positioned 180° apart. In another embodiment, the handle assembly 104 may include more or less than the depicted two handles 136, 138. A flange 142 extends inwardly from an inner portion 144 of the rim 130. As shown in FIGS. 4 and 5, in an assembled condition of the drinking cup 100, the rim 130, particularly the flange 142, is supported on the collar 120.

The lid 106 is mounted on the container 102 to prevent liquid in the drink container 102 from spilling out of the drink container when the drink container is tipped over. The lid 106 includes a top wall 150, an outer side wall or skirt 152 extending downwardly from the top wall 150, and a spout 154 extending upwardly from the top wall 150. The spout 154 defines a drink passage 156 extending through the lid 106 and in fluid communication with the open top 110 of the container 102. The top wall 150 in the illustrated embodiment is circular in plan view, i.e., normal to the container axis CA. The skirt 152 is cylindrical in configuration in the illustrated embodiment. With reference to FIGS. 4 and 5, internal threads 160 extend inwardly from the skirt for threading onto the complementary external threads 118 located on the container neck 114 to connect the lid 106 with the drink container 102. It should be appreciated that the lid 106 could fit onto the drink container in other conventional manners, e.g., a snap or bayonet connection. As depicted, when the lid 106 is coupled to the container 102 the handle assembly 104 is held into place by flange 142 being sandwiched by an edge of the skirt 152 and the collar 120.

The lid 106 further includes a downwardly extending lower wall 166 which is offset inwardly from the skirt 152. A ring-shaped gasket (not shown) could be received between the lower wall 166 and the skirt 152 to provide a seal between the lid 106 and the drink container 102 when the lid is connected with the drink container. The lid 106 further includes a valve mounting structure 168. A valve member (not shown) is mounted to the valve mounting structure 168. As is well known, the gasket and valve member prevent the spillage of liquid from the drink container 102 through the lid 106 for ease of use by a child or an elderly user (not shown), and even for use by the general public for spill-and-worry-free transportation of the drinking cup 100.

Figure 6:
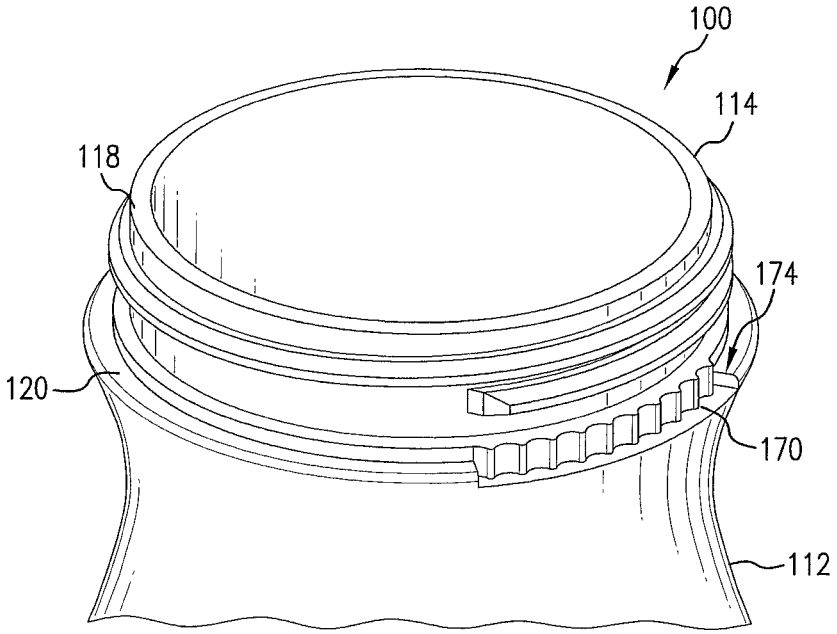
FIG. 6 is an enlarged perspective view of the exemplary drinking cup according to another aspect of the present disclosure.

With reference to FIGS. 2-5, the drink container 102 and the handle assembly 104 have a cooperating detent arrangement configured to allow rotational movement of the handle assembly 104 in predetermined increments about the container axis CA. This detent arrangement allows the user to orient the handles 136, 138 correctly with respect to the spout 154 provided on the lid 106. In the depicted embodiment, the neck 114 of the drink container 102 has a plurality of first detents 170 provided on the outer surface 116 and located at an interface between the collar 120 and the container neck 114. The handle assembly 104 has a plurality of second detents 172 shaped to mate with the first detents 170, wherein selective engagement of the first and second detents 170, 172 is configured to allow incremental rotational movement of the handle assembly 104 on the container neck 114 about the container axis CA. As depicted in FIG. 2, according to one aspect the plurality of first detents 170 can be located above the collar 120. For example the plurality of first detents 170 can be positioned on or slightly above an upper surface of the collar 120. As depicted in FIG. 6, according to another aspect the collar 120 can be segmented at 174 so that the plurality of first detents 170 is generally aligned with the collar 120 and can be offset from (i.e., at least partially below) the upper surface of the collar 120. Regarding both aspects of FIGS. 2 and 6, the rim 130 of the handle assembly 104 is supported by the collar 120 at a predetermined height on the container neck 114 to allow for the selective engagement of the first and second detents 170, 172.

In the illustrated embodiment, the rim 130 of the handle assembly 104 includes the plurality of second detents 172. More particularly, the plurality of second detents 172 is provided on an edge of the flange 142. A cutout 176 is provided between the rim and a section 178 of the flange 142 having the plurality of second detents 172. The cutout 176 allows the flange section 178 to be at least partially deflected toward the inner portion 144 of the rim 130 as the plurality of second detents 172 are moved over the plurality of first detents 170 during rotational movement of the handle assembly 104 on the container neck 114. According to one aspect, the plurality of first detents 170 includes a first set of first detents and a second set of first detents circumferentially spaced on the outer surface 116 of the neck 114 from the first set of first detents. As shown in FIGS. 2 and 3, the first and second sets of first detents 170 are positioned opposite to each other on the outer surface 116 (i.e., positioned 180° apart on the outer surface 116). Similarly, the plurality of second detents 172 can include a first set of second detents and a second set of second detents circumferentially spaced on the flange 142 from the first set of second detents. As depicted each of the first and second sets of first detents 170 has a circumferential length greater than a circumferential length of each of the first and second sets of the second detents. With this configuration and to ensure proper incremental rotation of the handle assembly 104, the plurality of second detents 172 further includes a third set of second detents and a fourth set of second detents. A circumferential spacing between each set of second detents 172 is substantially equal and less than the circumferential length of each set of first detents 170. Therefore, at all rotational positions of the handle assembly 104 on the container neck 114, at least one of the sets of second detents 172 is engaged with the first set of first detents 170 and at least another set of second detents 172 is engaged with the second set of first detents 170.

According to one aspect, the plurality of first and second detents 170, 172 of the detent arrangement can be defined by a plurality of ridges 190 and a plurality of protuberances 192 to be received in grooves 194 defined by the ridges 190. With this arrangement, one of the ridges 190 and protuberances 192 is located at the interface between the collar 120 and the neck 114 and the other of the ridges and protuberances is provided on the flange 142 of the rim 130. In the depicted embodiment, the plurality of first detents 170 are defined by the ridges 190 and the plurality of second detents 172 is defined the protuberances 192, and the cutout 176 allows for partial deflection of the flange section 178 as the protuberances 192 are moved over the ridges 190.

With reference again to FIGS. 4 and 5, the handle assembly 104 further includes a lip 200 extending inwardly from the rim 130. The lip 200 is spaced from the flange 142 and abuts the collar 120 where the first and second detents 170, 172 are engaged. The lip 200 can maintain a predetermined spacing between the engaged first and second detents 170, 172 which allows for easier movement of the second detents 172 over the first detents 170. Further, in a fully secured position of the lid 106 on the container 102 the skirt 152 of the lid is spaced from the collar 120 and is in contact with the flange 142. Therefore, the contact of the lid skirt 152 with the flange 142 does not inhibit the rotational movement of the handle assembly 104 on the container neck 114.

As is evident from the foregoing, an exemplary method of assembling a drinking cup 100 comprises providing a container 102 including a neck 114 having external threads 118; providing one of a plurality of ridges 180 and a plurality of protuberances 182 on the container neck 114; providing a handle assembly 104 including a rim 130 and pair of handles 136, 138 integrally formed with the rim; providing the other of the plurality of ridges 180 and a plurality of protuberances 182 on the rim 130 of the handle assembly 104; and positioning the rim 130 of the handle assembly 104 over the container neck 114 including positioning the plurality of protuberances 182 in grooves 184 defined by the plurality of ridges 180. The exemplary method further comprises providing a lid 106 having internal threads 160 configured to mate with the external threads 118 of the container neck 114, and screwing the lid 106 onto the container neck.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A drinking cup comprising:

a container with an open top and defining a longitudinal axis, the container including a neck having a plurality of first detents provided on an outer surface and an annular collar extending outwardly from the outer surface of the neck;

a handle assembly including a rim and at least one handle integrally formed with the rim, the rim defining an opening sized to receive the container neck, the handle assembly having a plurality of second detents shaped to mate with the first detents, wherein the rim includes an inner surface having an inwardly extending flange, the flange being supported on the collar, the plurality of second detents provided on the flange, wherein selective engagement of the first and second detents configured to allow incremental rotational movement of the handle assembly in both a clockwise direction and counterclockwise direction around an entirety of the container neck about the container longitudinal axis, and a lid removably coupled to the container neck, the lid having a spout in fluid communication with the open top of the container, wherein in a fully secured position of the lid on the container a skirt of the lid is spaced from the collar with the flange positioned between the skirt and the collar and the lid in the fully secured position does not inhibit the rotational movement of the handle assembly on the container neck.

2. The drinking cup of claim 1, wherein the plurality of first detents is located at an interface between the collar and the container neck.

3. The drinking cup of claim 1, wherein a cutout is provided in a radial direction relative to the container longitudinal axis between the rim and a section of the flange having the plurality of second detents to space the second detents from the inner surface, the cutout allowing the flange section to be at least partially deflected toward the rim as the plurality of second detents are moved over the plurality of first detents during rotational movement of the handle assembly.

4. The drinking cup of claim 1, wherein the handle assembly further includes a lip extending inwardly from the rim, the lip being spaced in an axial direction relative to the container longitudinal axis from the flange and abutting the collar where the first and second detents are engaged.

5. The drinking cup of claim 1, wherein contact of the lid skirt with the flange does not inhibit the rotational movement of the handle assembly on the container neck.

6. The drinking cup of claim 1, wherein the plurality of first detents includes a first set of first detents and a second set of first detents circumferentially spaced from the first set of first detents.

7. The drinking cup of claim 6, wherein the plurality of second detents includes a first set of second detents and a second set of second detents circumferentially spaced from the first set of second detents.

8. The drinking cup of claim 7, wherein the plurality of second detents includes a third set of second detents and a fourth set of second detents, a spacing between each set of second detents being substantially equal.

9. A method of assembling a drinking cup comprising:

providing a container including a neck having external threads and an annular collar extending outwardly from the outer surface of the neck;

providing one of a plurality of ridges and a plurality of protuberances on the container neck;

providing a handle assembly including a rim and pair of handles integrally formed with the rim, the rim including an inner surface having an inwardly extending flange;

providing the other of the plurality of ridges and a plurality of protuberances on the flange of the rim of the handle assembly;

positioning the rim of the handle assembly over the container neck including positioning the plurality of protuberances in grooves defined by the plurality of ridges to allow incremental rotational movement of the handle assembly on the container neck, and supporting the flange of the rim on the annular collar; and providing a lid having internal threads configured to mate with the external threads of the container neck, and screwing the lid onto the container neck with the flange positioned between the collar and a skirt of the lid, wherein in a fully secured position of the lid on the container neck the lid does not inhibit the rotational movement of the handle assembly in both a clockwise direction and counterclockwise direction around an entirety of the container neck.

* * * * *